United States Patent [19]

Kjaer et al.

[11] 4,368,744

[45] Jan. 18, 1983

[54] DEVICE FOR SPREADING WHOLE TOBACCO LEAVES

[75] Inventors: Ian Kjaer, Hadsund; Hans J. Moeller, Harlev J; Niels E. Mortensen, Gistrup, all of Denmark

[73] Assignee: Skandinavisk Tobakskompagnie A/S, Soborg, Denmark

[21] Appl. No.: 258,445

[22] Filed: Apr. 28, 1981

[30] Foreign Application Priority Data

May 12, 1980 [DK] Denmark ..... 2071/80

[51] Int. Cl.[3] ..... A24C 1/02; A24C 1/04; A24C 1/26

[52] U.S. Cl. ..... 131/324; 131/315

[58] Field of Search ..... 131/324, 315

[56] References Cited

U.S. PATENT DOCUMENTS

| | | | |
|---|---|---|---|
| 2,212,520 | 8/1940 | Gwinn et al. | 131/315 |
| 3,409,024 | 11/1968 | Menguy | 131/315 |
| 3,612,067 | 10/1971 | Wallenborg | 131/324 |
| 3,699,977 | 10/1972 | Hollenton | 131/324 |
| 3,759,269 | 9/1973 | Wallenborg | 131/315 |
| 3,800,807 | 4/1974 | Hays et al. | 131/324 |

*Primary Examiner*—V. Millin

*Attorney, Agent, or Firm*—Stevens, Davis, Miller & Mosher

[57] ABSTRACT

A device for spreading tobacco leaves comprises a suction box with a perforated wall and a shield composed of a plurality of sections transversely movable outwards from a closed position in which they cover the perforated wall with the exception of a central area against which the mid rib portion of the tobacco leaf can be clamped by means of a rail. The leaf is held by suction against the shield sections during their opening movement and is so spread and stretched transversely in a direction away from the mid rib. Trailing brushes that are moved outwards together with the shield sections are further provided for this purpose. The perforated wall may comprise knives which, when being run over by a roller, cut out wrappers or binders or blanks therefor from the tobacco leaf while this is still being held firmly against the wall after full opening of the shield.

6 Claims, 3 Drawing Figures

DEVICE FOR SPREADING WHOLE TOBACCO LEAVES

FIELD AND BACKGROUND OF THE INVENTION

The invention relates to a device for spreading whole tobacco leaves on a table by smoothing out and stretching the two halves of the leaf in a direction away from its mid rib.

Such a device is for instance known from the specification of U.S. Pat. No. 4,005,719, according to which a brush is positioned above the proper spread-table and is arranged to be lowered towards and raised from the table. When the brush is in its raised position a tobacco leaf is manually fed laterally across the table until the foremost lateral edge of the leaf has passed the brush which is then lowered towards the table and smoothes the leaf transversely by its continued advance movement. The use of said prior device provides for achieving an excellent spreading of moistened tobacco leaves, but only a minimal stretching is obtained. The apparatus further requires considerable manual work and involves a certain risk of tearing the mesophyll, in particular if the leaf has beforehand been slightly damaged by holes or scratches.

AIM AND SUMMARY OF THE INVENTION

The device according to the present invention may be considered a further development of said prior spreading device, as this invention aims at improving and intensifying the spreading and reducing the risk of damage to the leaf, as well as facilitating the manual work of the operator.

The device according to the invention is characterised in that the table comprises a perforated wall of a suction box and an air permeable shield including at least two sections that, from a closed position in which they altogether cover the perforated wall with the exception of an area corresponding to a portion of the tobacco leaf at its mid rib, are movable from each other into an open position in which the perforated wall is laid open over an area, the size of which corresponds at least to the spread tobacco leaf.

When using this apparatus the operator feeds the tobacco leaf on to the closed shield until its mid rib portion lies above the uncovered area of the perforated wall. During this step it is preferred to provide a moderate vacuum in the suction box to cause the leaf to "adhere" to the shield and to the perforated wall between the shield sections. After the leaf has been correctly positioned the suction box can be subjected to a higher vacuum, and the shield sections are subsequently moved towards their open position and are so drawn away beneath the tobacco leaf that due to the vacuum is kept in sliding contact with the shield sections. The transversal stress thus created in the leaf will at a certain moment considerably influence the portions of the leaf which are just about to getting clear of the shield sections, and which immediately afterwards, i.e. while being still subjected to stress, are firmly fixed by suction to the perforated wall. It has proved possible in practice to obtain such an intensive stretching of the tobacco leaf that after its release from the suction box the leaf seems "dead" of inelastic and thus is better suited for subsequent processing, e.g. cutting wrappers and application of the wrappers to a tobacco article. It has surprisingly been found that, despite the strong stretching, the tendency to tearing of the tobacco leaves has been reduced in comparison with the prior spreading devices with brushes, in particular in cases where rotary brush rollers or circulating brush belts are used. When using such brushes there is a considerable risk that the bristles tear already existing tiny holes in a leaf and thus make it unfitted for the intended purpose, i.e. production of cut or punched wrappers or binders. Per contra, by the operation of the device according to the invention the edges of any holes are relieved of tearing forces because air may leak through the hole, resulting in a local decrease of the forces that might exert a damaging effect. In other words, by the suction the undamaged portions of the tobacco leaf will inevitably be fixed most efficiently to the perforated wall and the shield.

According to the invention it is preferred to provide a rail above the area of the perforated wall that is uncovered when the shield is in its closed position, said rail being movable towards and away from the wall and capable of clamping the mid rib portion of the tobacco leaf directly against the wall. Such a clamping rail is particularly important at the beginning of the spreading operation, where only a narrow portion of the leaf along its mid rib rests against the perforated wall, which might involve the risk of an unintended transverse displacement of the leaf due to unbalance between the spreading and stretching forces exerted by the shield sections. Said risk can be entirely eliminated by said clamping rail.

The shield may appropriately comprise two symmetrical sections movable transversely to the tobacco leaf placed on the table, and the surfaces of which present guide ribs which are concave towards the centre of the table. While the leaf is being stretched transversely due to the outward movement of the shield sections towards the open position, the guide ribs will also cause a certain longitudinal stretching that is useful for the subsequent processing of the tobacco leaf and further contributes to increasing its area, so that it may become possible from a tobacco leaf of a certain size (prior to spreading) to cut out wrappers which would otherwise have required a larger and consequently more expensive tobacco leaf as starting material.

An inexpensive possibility is to produce the shield sections from metal wire-netting. This material has the further advantage of presenting a smooth but nevertheless uneven or rough surface with closely spaced holes resulting in a uniformly distributed "microstretching" of the mesophyll by the relative movement between the leaf and the shield.

According to the invention, at least one brush may appropriately be associated with each section of the shield, said brush being movable both together with the shield section between its closed and its open positions and towards and away from the surface of the associated section in its closed and open position, respectively. While the shield is moving towards the open position the brushes contribute to intensifying the sliding contact between the tobacco leaf and the shield, but their primary function is to smooth out the edge portions of the leaf that, when being placed in the device, are frequently wrinkled or folded up, so that they are not immediately fastened by suction as intended. The brushes remedy this deficiency and spare the operator the trouble of smoothing the edge portions with his fingers.

In a preferred embodiment of the device according to the invention the perforated wall comprises knives for cutting out wrappers or binders or blanks therefor from the tobacco leaf while this is still being held spread and stretched on the wall. Said knives can cooperate with a cutting roller movable in relation to the table so that the spreading and stretching of the tobacco leaves so to speak can be integrated with the cutting of the wrappers and binders to be produced from the prepared leaves. After the vacuum in the suction box has been suspended the cut wrappers and binders can be removed from the perforated wall and delivered directly to the point of use, for instance an ordinary wrapper applying apparatus, or they can be collected in bobbins for later use. In either case considerable rationalization and savings are obtained in comparison with common practice, according to which the tobacco leaves are transferred from the spreading device to a cutting or punching device that is separate in relation to the spreading device and requires supplementary manipulation of the leaves.

DETAILED DESCRIPTION OF THE PREFERRED EMBODIMENT

Figure 1:
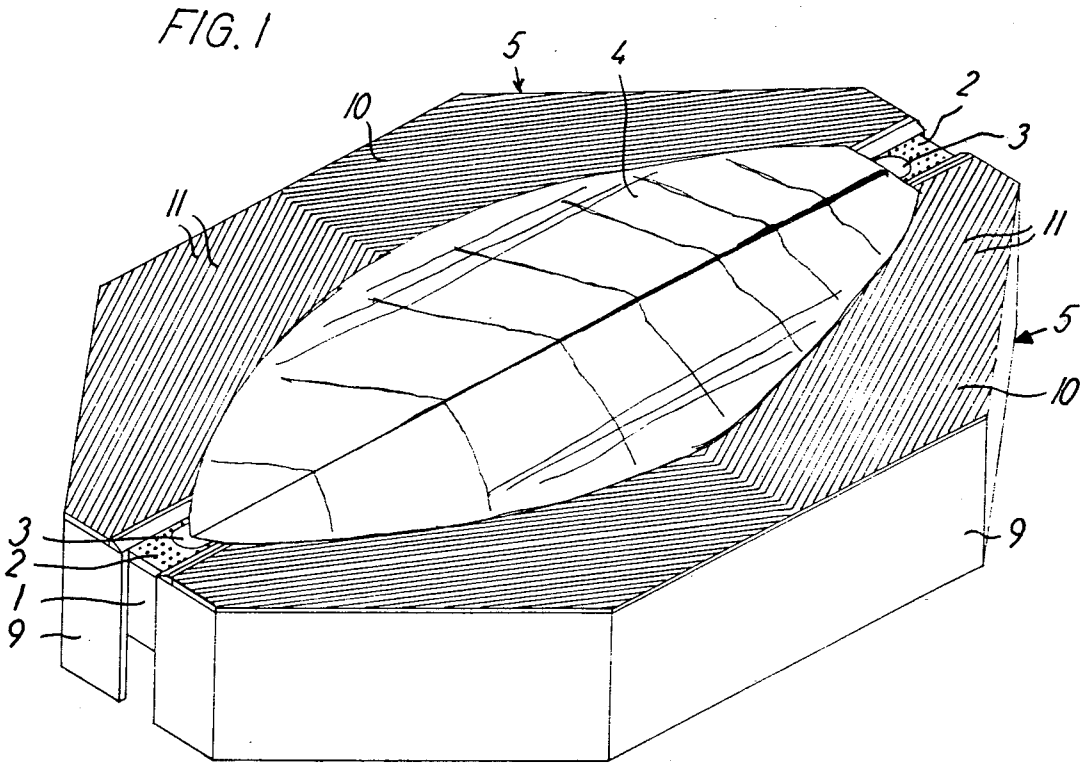
FIG. 1 shows the device with a two-piece shield in the closed position and with a tobacco leaf laid on it, but without any means, that may be ordinary per se, for moving the various elements and for providing the suction effect.
Figure 2:
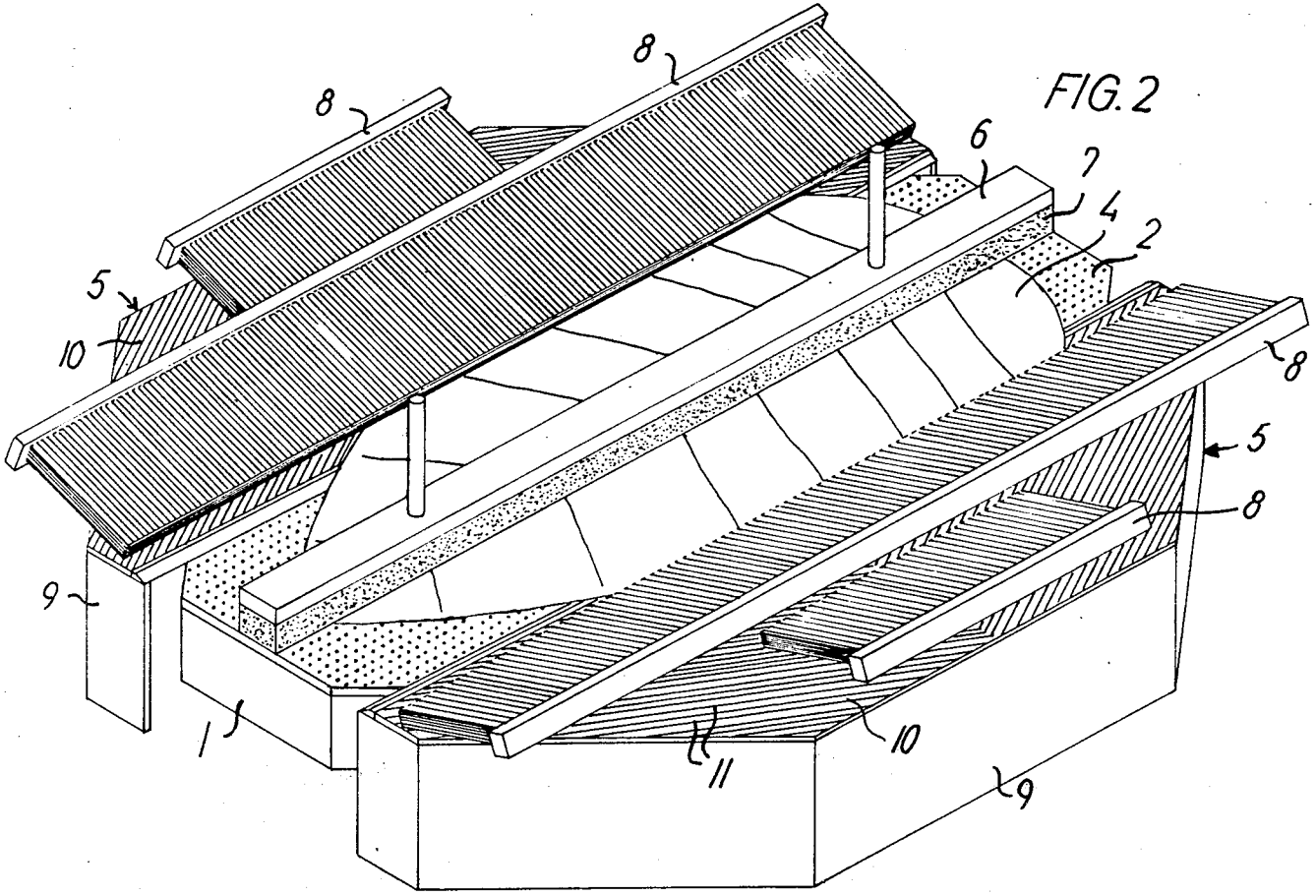
FIG. 2 is a similar view of the device during its spreading and stretching operation and with a clamping rail and two sets of operative smoothing brushes.

In the drawings 1 indicates a suction box comprising a perforated top plate 2 having an illuminated translucent field 3 to mark the optimum positioning of the mid rib portion of a tobacco leaf 4 as laid. Said field 3 is uncovered between the opposite edges of a pair of shield sections 5 which in the position shown in FIG. 1 otherwise cover the plate or wall 2 and form a base for the tobacco leaf 4. Said leaf can be fed laterally onto the shield 5,5 in the same way as used with the known spreading device referred to in the foregoing, but it may as well be laid on mechanically, for instance by a conveyor for feeding the leaf in its longitudinal direction.

Figure 3:
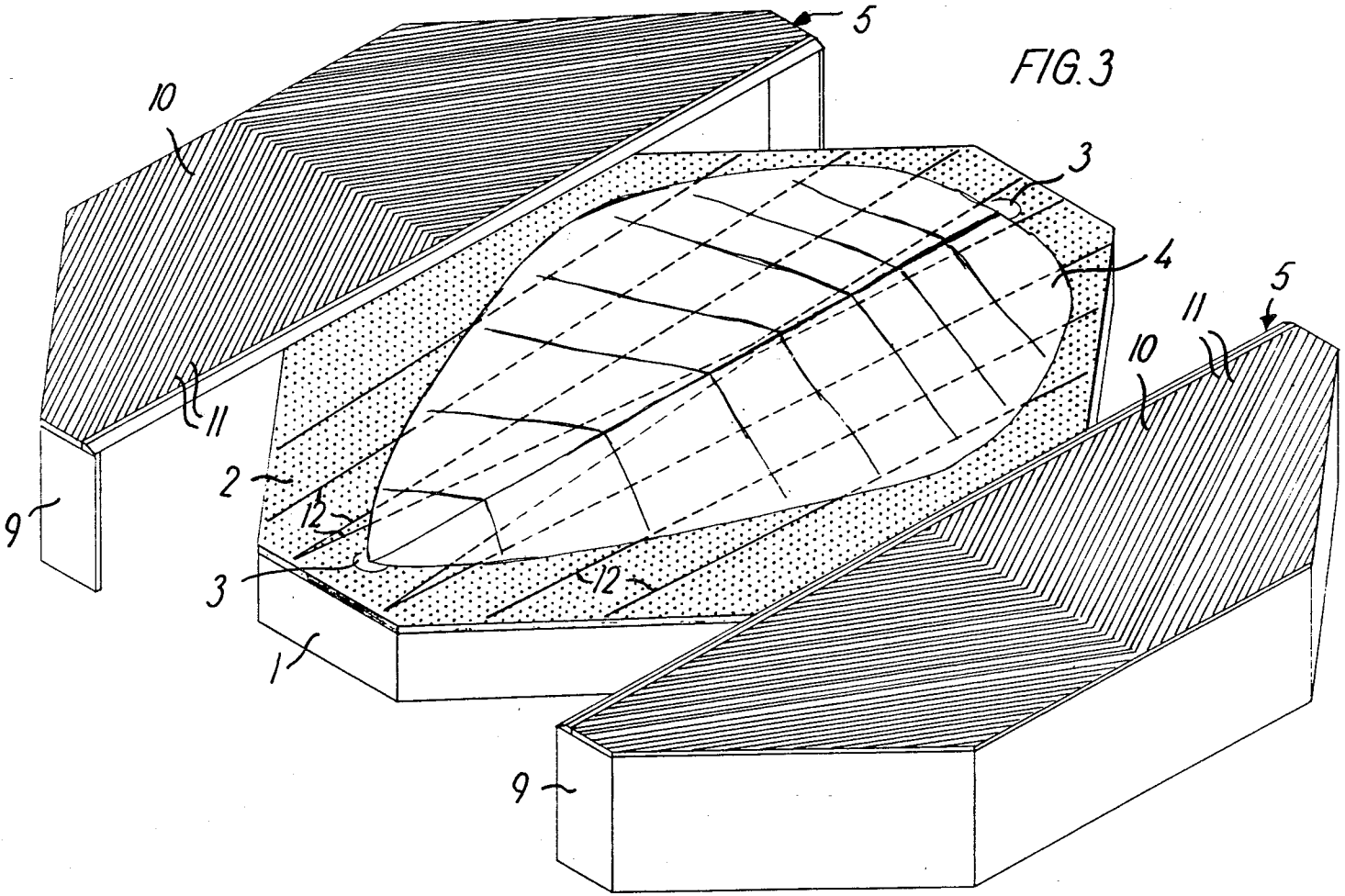
FIG. 3 shows the situation after the termination of the spreading and the smoothing operation.

After the tobacco leaf 4 has been positioned, its mid rib portion is clamped against the perforated wall 2 by a vertically movable clamping rail 6 provided with a suitably soft layer 7, appropriately a strip of sponge nylon or similar material. While the rail 6, 7 is moved into its clamping position a pair of brush sets 8 are lowered into contact with the tobacco leaf 4, following which said brushes as well as the shield sections 5 are moved transversely outwards with a suitable vacuum in the suction box 1. The tobacco leaf 4 is thus spread and stretched as explained above and lies finally smoothed and stretched on the wall 2 of the suction box as shown in FIG. 3. The tobacco leaf is released on relief of the vacuum and can be removed for further processing, and after the shield 5, 5 has been closed again the device is ready for the next operation.

In the illustrated embodiment each of the shield sections consists of a supporting lateral wall 9 and an upper plate 10 of wire-netting with intersecting threads, of which only the longitudinally extending ones are shown. These threads or wires form guide ribs 11 which form the centre line of the top plate 10 extend inwards towards the inner edge, thereby subjecting the tobacco leaf 4 to a certain longitudinal stretching when the shield moves towards its open position.

If desired, the longitudinal stretching may be intensified by dividing the shield 5, 5 into more sections which at least when closed can have overlapping relationship and are reciprocally movable in directions having both a transverse and a longitudinal component.

As illustrated schematically in FIG. 3 the suction box 1 may comprise knives 12, the cutting edges of which project slightly above the top surface of the wall 2 or they can be brought into such a position after the termination of the smoothing and stretching operation. When the shield 5, 5 is in its open position said cutting edges may be run over by a roller, not shown, so that it is possible in immediate continuation of the smoothing and stretching operation to cut out wrappers or binders or blanks therefor from the tobacco leaf while still being secured to the spread base, i.e. the wall 2. In the illustrated embodiment the knives are arranged to cut blanks in the form of strips but they may as well be shaped like the contour of the wrappers or binders to be produced.

We claim:

1. A device for spreading whole tobacco leaves, comprising a table constituted by a perforated wall of a suction box, and an air-permeable shield including at least two sections that are movable between a relatively closed position in which they together cover said perforated wall with the exception of a central elongated area thereof, for receiving the mid rib portion of the tobacco leaf to be spread, and a relatively open position in which the width of said area of the perforated wall is increased to correspond at least to the width of the spread tobacco leaf.

2. A device as claimed in claim 1, further comprising a rail mounted above the area of the perforated wall that is uncovered by the shield sections when in their relatively closed position, said rail being movable towards said wall to clamp the mid rib portion of the tobacco leaf against the wall.

3. A device as claimed in claim 1, wherein said shield comprises two symmetrical sections that are movable transversely to the longitudinal direction of said area of the perforated wall, and the tobacco leaf receiving surfaces of which present guide ribs that are concave towards said area.

4. A device as claimed in claim 1, 2 or 3, wherein the tobacco leaf receiving surfaces of the shield sections are formed of metal wire-netting.

5. A device as claimed in claim 1, wherein at least one brush is associated with each section of the shield, said brush being movable together with the associated shield section between the relatively closed and the relatively open positions thereof and also towards and away from the surface of the associated section in the relatively closed and open positions thereof, respectively.

6. A device as claimed in claim 1, wherein knives are incorporated in the perforated wall for cutting out wrappers or binders or blanks therefor from the tobacco leaf while still being held spread and stretched on said wall.

* * * * *